United States Patent [19]

Walther

[11] B 4,000,837

[45] Jan. 4, 1977

[54] SLIDING GATE VALVES

[75] Inventor: Ludwig Walther, Dueren-Niederau, Germany

[73] Assignee: United States Steel Corporation, Pittsburgh, Pa.

[22] Filed: Dec. 16, 1974

[21] Appl. No.: 532,976

[44] Published under the second Trial Voluntary Protest Program on March 23, 1976 as document No. B 532,976.

[30] Foreign Application Priority Data

Dec. 21, 1973 Germany ..... 2363824
Dec. 21, 1973 Germany ..... 7345365[U]

[52] U.S. Cl. ..... 222/512; 222/561
[51] Int. Cl.[2] ..... B22D 37/00; B22D 41/08
[58] Field of Search ..... 266/38, 42; 164/281; 222/504, 512, 561

[56] References Cited

UNITED STATES PATENTS

| | | | |
|---|---|---|---|
| 3,709,411 | 1/1973 | Shapland | 222/512 |
| 3,730,401 | 5/1973 | Bode, Jr. | 222/512 |
| 3,764,042 | 10/1973 | Shapland et al. | 222/512 X |
| 3,866,806 | 2/1975 | Shapland, Jr. | 222/504 |

*Primary Examiner*—Robert B. Reeves
*Assistant Examiner*—David A. Scherbel
*Attorney, Agent, or Firm*—Walter P. Wood

[57] ABSTRACT

A sliding gate valve for pouring molten metals has a slide carriage bearing a slide plate and a separate pouring bushing, the latter being mounted in a flanged collar and the carriage having spring loaded bolts, (i) to press the flange of the bushing collar against the slide plate and (ii) to press the slide plate against a head plate of the valve, to seal bushing to slide plate and slide plate to head plate, and the slide and head plates being identical and having identical sealing means.

14 Claims, 3 Drawing Figures

SLIDING GATE VALVES

Figure 1:
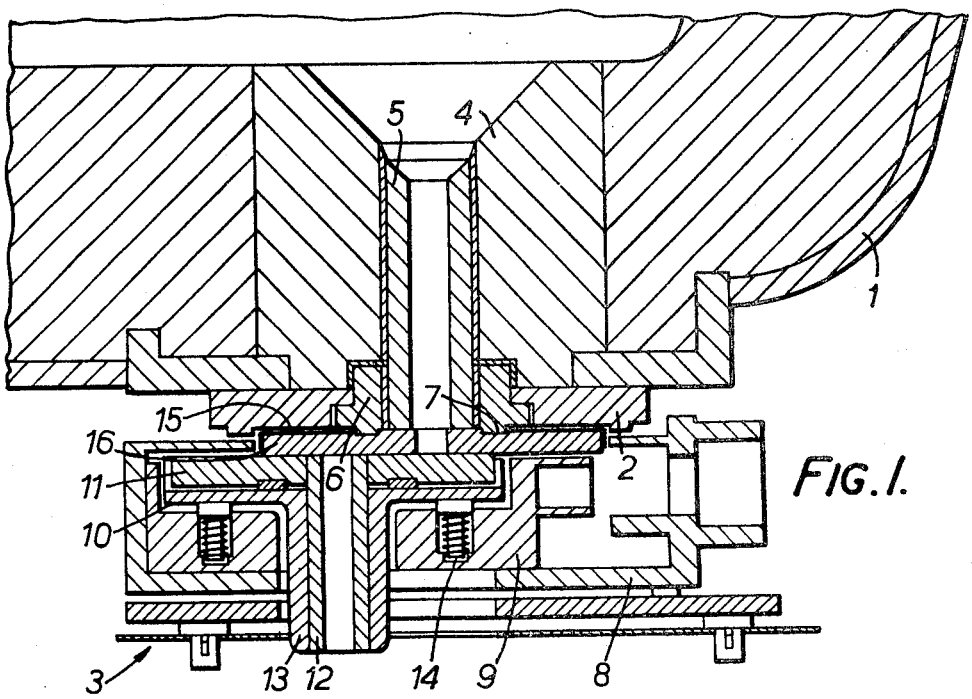

The present invention relates to improvements in sliding gate valves.

Sliding gate valves are used, inter alia, to control the teeming of molten metals such as steels from bottom-pour vessels or ladles.

A known type of sliding gate valve comprises a fixed replaceable ceramic head plate which is mounted in a steel frame and is placed underneath a pouring block in the bottom of a ladle. The head plate and pouring block are sealed by means of a circular groove in, say, the pouring block and a spring associated with the head plate. A replaceable, ceramic sliding plate housed in a sliding frame is urged against the underneath of the head plate, the sliding plate being provided with a ceramic pouring bushing which is mounted in a steel casing. The sliding plate can be pressed against the head plate by spring loaded bolts and can be shifted with respect to the head plate to open and close the valve, preferably by means of a power operator.

This type of slide valve has proven its value in practice. Mechanically and thermally stressed parts of the valve, especially, the head plate, the sliding plate and the pouring bushing are made of a hard, fire-resistant ceramic material, and are easily accessible so that they can be inspected and replaced at short intervals. The ceramic elements of the valve, which are the principal parts subject to wear, are mounted either in a steel frame or casing to increase their ability to withstand handling, to balance manufacturing tolerances and to prevent high local compression stresses due to sealing with cement, and this has proven to be a drawback. In the case of the head plate this drawback is barely noticeable: the head plate is mounted, as a single unit, in its encompassing steel frame. This arrangement is relatively simple and can be built without great expense. But, in making the sliding plate, it becomes clear that the construction of the steel casing is relatively complicated and that it must be provided with a pot-shaped holder for the pouring bushing. In this casing, the pouring bushing and its supports must be mounted. The sliding plate is provided with a hole to encompass the throat of the pouring bushing, and this plate has to be placed into the casing and sealed with cement. This multiple-step manufacturing procedure has drawbacks and is expensive. The manufacturing steps are time consuming and the ceramic parts must be mounted with close tolerances. The pouring bushing has to be tightly sealed with respect to the sliding plate but during assembly, which is usually performed on a vibrating machine, cement provided between the pouring bushing and the sliding plate can rise above the working surface of the sliding plate and, occasionally, can run over this surface. The finished assembly of the steel casing, the sliding plate, the pouring bushing and its support is bulky and heavy, making handling difficult. This drawback is particularly noticeable in the case of large sliding plates provided with more than one pouring opening.

Objectives of the invention are to decrease the manufacturing cost of the sliding plate and pouring bushing assembly, to simplify and to decrease the weight of the means required for the replacement of the sliding plate, to decrease the wear, to rationalize storage of parts and to decrease the manufacturing cost of the sliding plate assembly.

Another objective of the invention is to enable the ultimate user to select combinations of sliding plates and pouring bushings made from a range of different materials, so as best to suit his needs, bearing in mind the nature of the metals to be poured.

According to the present invention, there is provided an improved sliding gate valve for a bottom pour vessel, wherein the valve comprises a replaceable ceramic head plate adapted for rigid, sealed mounting on the vessel, a slideable carriage and a replaceable ceramic slide plate borne thereon and carrying a pouring bushing, whereby said slide plate is movable in contact with said head plate to bring the bushing into and out of registry with the head plate aperture to open and close the valve, the improvement comprising: first and second frames in which said head plate and said slide plate are respectively mounted, cooperating sealing means on said bushing and said slide plate, a collar having an extended top flange and forming a holder for said bushing, said top flange being capable of abutting the slide plate, and spring elements carried by said carriage to engage said top flange and urge same against said slide plate.

The invention also comprehends a subassembly consisting of the pouring bushing, slide plate and carriage.

Manufacturing of a preferred embodiment has been simplified by eliminating the assembly of the pouring bushing with the slide plate involving the engagement of parts and by making the pouring bushing simply abut the slide plate, from underneath. It has been proved advantageous to seal the slide plate in the steel frame and/or to seal the pouring bushing in the steel collar with cement.

The engagement of the sealing elements during assembly is simplified, and the sealing elements are protected from mechanical overloading, if the slide plate is provided with ribs which encompass and center the collar, the ribs advantageously having lips having a spring action. It is expedient if the steel frame is provided with a central opening, only slightly larger than the mounting diameter of the pouring bushing.

Under these conditions, the flange of the said collar grips from underneath the steel frame and can provide additional support in the operating position.

It has been found useful to provide the carriage with two sets of spring elements located along the arcs of circles having two different diameters, such that one set of spring elements acts on the collar flange only whilst the other set acts on the second frame only. Equal spring characteristics of the spring elements can be obtained, where the said elements are spring-loaded bolts, by increasing by the thickness of the collar flange the length of the stems and/or the height of the heads of the spring elements, which act upon the second frame, with respect to the spring elements which act on the said flange.

The manufacture of the slide plates and the storage of elements which are subject to wear, are desirably rationalised by making the head plates and the slide plates of the same shape and dimensions and by mounting them in steel frames having the same dimensions. Also, for this purpose sealing elements for sealing the pouring bushing to the slide plate and for sealing the head plate to a vessel pouring block are made the same. Adaptation of a sliding gate valve to a particular melt can go very far in a valve embodying the invention by using different materials for the sliding plate and for the pouring bushing.

The advantages of the invention also exist in the case of sliding plates provided with two or more pour openings. Then the sliding plates are provided, on their sides opposite to the head plates, with sealing elements located for each of the outlet openings, and the carriage is provided with mounting openings and associated centering elements and spring elements for a plurality of collar-mounted pouring bushings. Different pouring characteristics can be obtained by using pouring bushings defining flow passages of differing cross-sectional areas. The openings in the slide plate should match the sizes of the passages in the pouring bushings.

Figure 2:
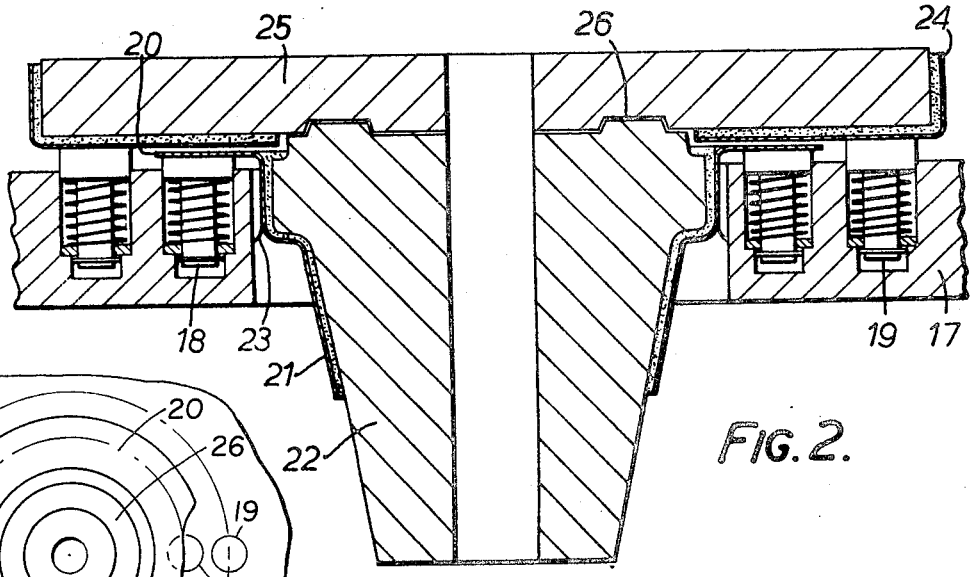
Figure 3:
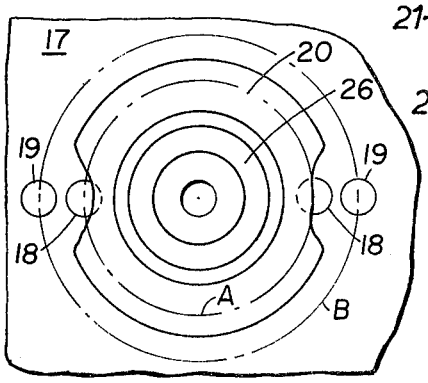

The invention will now be described in more detail by way of example only with reference to the accompanying drawings, in which FIG. 1 is a cross-sectional view showing part of a ladle to which is fitted a sliding gate valve, FIG. 2 is an enlarged cross-sectional view showing the sliding plate, pouring bushing and spring means of a valve embodying the present invention and FIG. 3 is a diagrammatic top plan view of the sliding frame, pouring bushing and flange shown in FIG. 2.

In FIG. 1, a longitudinal section of a portion of a bottom-pour ladle 1 is shown, the ladle having a bottom-pour opening encompassed from underneath by a sliding gate valve 3 which is attached to a mounting plate 2. The wall structure of the ladle includes a block 4 in which a hole is provided, the hole having a two part lining comprising an inner bushing 5 and an outer bushing 6 around the lower end of bushing 5. The bushing 6 is provided with a sealing spring washer 7.

The gate valve has a slider housing 8 attached to mounting plate 2 by articulated elements, which are not shown on the drawing, and is locked in the indicated position. In the slider housing 8 there is a power operated sliding frame 9 which can move in the longitudinal direction and which carries the valve sliding plate 11 which in turn is mounted in a steel casing 10. Casing 10 contains a pouring bushing or nozzle 12 which extends through the casing and through the sliding plate 11, the bushing 12 being mounted in a holder 13. The heads of spring loaded bolts 14, provided in recesses in the sliding frame 9, abut the underneath of the casing 10 and urge the sliding plate 11 towards the block 4. A head plate 16 is mounted in a steel frame 15 and is cemented to the free end surfaces of the inner bushing 5 and the outer bushing 6. Sliding plate 11 is pressed against the head plate 16 by the spring elements 14 so that sliding surfaces of the head plate and of the sliding plate abut. At the same time the spring washer 7 of outer bushing 6 penetrates into a matching circular groove in the head plate 16 and provides the required sealing of the head plate 16 to the ladle bottom.

The underside of the slider valve 3 is covered with shielding plates, and sliding frame 9 and housing 8 are provided with "bayonet" type sockets, seen at the right hand side of the drawing, for coupling to a hydraulic cylinder positioning device, not shown.

The sealing of head plate 16 in steel frame 15 by means of cement presents no particular difficulties since only two parts have to be adjusted and secured in their proper positions. Also the size and weight of the head plate 16 and its steel frame 15, are such as to make effortless handling possible and to make the transportation and the storage of the unit simple. However, the drawbacks of the assembly comprising sliding plate 11 become apparent during manufacturing, transportation and handling. Manufacturing is made difficult because parts involving separate manufacturing steps must be mounted within close tolerances in steel casing 10 and because the finished assembly is cumbersome and particularly difficult to handle on account of its considerable weight. The last-mentioneed drawback is aggravated in the case of sliding plates which are provided with more than one outlet opening. The steeel casing 10 then comprises more than one protruding, pot-shaped holder fitted with the corresponding number of pouring bushings.

The drawbacks just discussed can be eliminated if the sliding plate and associated elements carried thereby is built according to FIG. 2. FIG. 2 shows a sliding frame 17 provided with two groups of spring-loaded bolts 18 and 19, the groups being located at different distances from the centre of an opening provided for the pouring bushing or nozzle. The vertical axes of bolts 18 and the encircling spring elements are located on an arc A, and the vertical axes of bolts 19 and the encircling spring elements are located on an arc B, as shown in FIG. 3. Spring loaded bolts 18, in the group located closer to the opening, abut the underneath, of flange 20 of a steel collar 21 into which the pouring bushing 22 is mounted and sealed with cement. The proper position of the pouring bushing is ensured, within close tolerances, by the fact that the position is, already determined during mounting into the steel collar and by the fact that the steel collar 21 is properly mounted in the said opening of the frame 17 by the action of centering lips 23. After assembling the steel collar 21 and the pouring bushing 22 together, a steel frame 24 is placed on the sliding frame 17. The sliding plate 25 is then placed in the steel frame 24 and sealed in with cement. Spring loaded bolts 19 of the group further from the mounting opening of the sliding frame 17 engage the steel frame 24 for pressing the latter upwardly.

In this example, the sliding plate 25 has exactly the same shape as the head plate 16 of FIG. 1. The sliding plate operates in conjunction with the head plate and is mounted, in a similar fashion in a steel frame, having the same dimensions as the frame of the head plate. The underside of the sliding plate 25 is provided with a circular groove, which is similar to the one provided on the upper face of the head plate 16, for sealing purposes also. Pouring bushing 22 is provided with a spring washer 26, on the side thereof facing sliding plate 25, washer 26 having the same dimensions as spring washer 7 of outer bushing 6. Washer 26 is intended to penetrate into sliding plate 25 to provide the required sealing.

Considerable rationalization of manufacture, transportation and storage clearly is obtained since, by the use of identical dimensions and mountings for the head and for the sliding plate, the parts are interchangeable.

Storage is favorably influenced by the interchangeability of the parts because the economical quantity thereof to be stored is less than twice the economic quantity of parts which would have to be stored, corresponding to the case were the head and sliding plates of different design. Of great importance is also the fact that handling is considerably facilitated because of the division of weight, and manufacturing becomes considerably cheaper because of the division into separate parts requiring only one step assembly operations.

In principle, it is possible, with one set of spring loaded bolts, to engage the underneath of flange 20 of collar 21 and to apply pressure to the underside of steel frame 24, thereby using the spring forces to press the sliding plate 25 against the head plate 16. To preclude local mehcanical overloading, the dimensions can be selected in such a way that, when flange 20 rests on steel frame 24, and when spring washer 26 of outer bushing 22 is engaged in the circular groove of sliding plate 25, no thrust is transmitted through their surfaces. On the other hand, especially in case of additional preloading of the flange, it is possible to transfer at least a portion of this thrust to the spring washer and to the circular groove. The distribution of thrust can be adjusted, even in the case of spring elements with identical springs and identical displacements, by changing the lengths of the stems and/or the heights of the heads of spring loaded bolts 18 with respect to the spring loaded bolts 19. By increasing the height of the heads of spring loaded bolts 19 with respect to those of spring loaded bolts 18 by the thickness of flange 20, equal thrusts and equal displacements are obtained for groups 18 and 19 of the spring loaded bolts.

The preferred valve construction can be modified in many ways within the spirit and scope of the appended claims. Thus it is not necessary to make flange 20 equally wide along its complete perimeter. It can be expedient to omit diametrically opposite segments along chords running parallel to sliding frame 17. Substantial advantages can be gained if the invention is applied to sliding plates provided with more than one outlet opening, although then the advantage of having identical sliding plates and head plates is lost. Nevertheless, the subdivision of weight is particularly important in the case of these complicated, cumbersome and heavy sliding plates, especially when they consist of an assemblage of a plurality of parts, and the high cost of manufacture by conventional methods can be decreased by the use of the invention. One advantage results from the separation of the pouring bushings. In case of wear exceeding a preset limit it is not necessary, anymore, to replace the sliding plate with all the pouring bushings. It suffices merely to replace the worn out bushing. The separation into individual parts provides exceptional advantages by making possible separate transportation and storage of sliding plates and pouring bushings, especially when the pouring bushings of the type described engage the sliding plate from underneath and have equal dimensions but are made of material having different compositions. In the case of highly stressed sliding plates, in which the greatest stresses occur in the region of the edges of the opening, expensive, hard to get, ceramic material comprising a large proportion of high quality aluminium oxide is used for the plates, while the pouring bushings can be made, for example, of fire bricks. On the other hand, a pouring bushing made of expensive high-stress ceramic material can be selected and used when the sliding gate valve is to be operated in a throttling mode. In this mode, a vortex can be created and, consequently, the inner surface of the pouring bushing is subjected to high stresses. Furthermore, the material of the sliding plates and of the pouring bushing can be selected in accordance with the composition of the poured metal. For example, if the aluminum content of the pouring bushing appears to have a detrimental effect, it is possible to select a pouring bushing made of fire bricks and, thus, to use, not only a cheaper material but at the same time to avoid the danger of reaction with ceramic materials containing high percentages of aluminum.

Thus the invention makes it possible to rationalize the manufacture of parts of sliding gate valves which are most exposed to wear, to rationalize storage and to simplify handling, without requiring any basic change in the current types of sliding gate valves. At the same time it makes it possible to store sliding plates and pouring bushings separately and to enable plates and bushings of different materials to be selected and used together in any desired combinations to suit different pouring conditions.

I claim:

1. In a sliding gate valve for a bottom pour vessel, wherein the valve comprises a replaceable ceramic head plate adapted for rigid, sealed mounting on the vessel, a slideable carriage and a replaceable ceramic slide plate borne thereon and carrying a pouring bushing, whereby said slide plate is movable in contact with said head plate to bring the bushing into and out of registry with the head plate aperture to open and close the valve, the improvement comprising:

first and second frames in which said head plate and said slide plate are respectively mounted, cooperating sealing means on said bushing and said slide plate, a collar having an extended top flange and forming a holder for said bushing, said top flange abutting the slide plate, and spring elements carried by said carriage to engage said top flange and urge same against said slide plate.

2. A valve according to claim 1, wherein further spring elements carried by said carriage engage said second frame.

3. A valve according to claim 2, wherein said spring elements and said further spring elements are respectively located along arcs of circles of two different diameters, whereby said first-mentioned spring elements are located inwardly of the periphery of said collar top flange and said second-mentioned further spring elements are located outwardly of said periphery.

4. A valve according to claim 2, wherein each of said spring elements and said further spring elements comprises a respective spring loaded bolt and wherein the bolts acting upon said second frame are longer than the bolts acting upon said top flange by the thickness of said top flange.

5. A valve according to claim 2, wherein each of said spring elements and said further spring elements comprises a respective spring loaded bolt and wherein the heads of those bolts acting upon said second frame are thicker than the heads of the bolts acting upon said top flange by the thickness of said top flange.

6. A valve according to claim 1, wherein said pouring bushing engages the underside of said slide plate.

7. A valve according to claim 1 wherein said slide plate is sealed with cement in said second frame and said pouring bushing is sealed with cement in said collar.

8. A valve according to claim 1 wherein said carriage includes centering ribs which encompass and center said collar with respect to said carriage.

9. A valve according to claim 1, wherein said second frame is apertured by a central opening the diameter of which exceeds slightly the adjacent external diameter of said pouring bushing.

10. A valve according to claim 1 wherein said slide plate and said head plate (16) have the same shape and dimensions and are mounted in first and second frames having the same dimensions.

11. A valve according to claim 10, including sealing means for sealing said head plate to said vessel.

12. A valve according to claim 11, wherein said sliding plate and said pouring bushing are made of materials of different composition.

13. A valve according to claim 1 mounted on a bottom pour vessel.

14. A sub-assembly for a sliding gate valve having apertured head and slide plates engageable with one another and relatively movable to open and close the valve, the sub-assembly comprising:

a carriage, a slide plate borne by said carriage, a separate pouring bushing associated with said slide plate and a flanged collar mounting said bushing, and sealing means for sealing said slide plate to said bushing, said carriage including spring elements engageable with the flange of said collar to urge same against said slide plate and thereby to seal said slide plate and bushing together.

* * * * *